US007401683B2

(12) United States Patent
Husmann et al.

(10) Patent No.: US 7,401,683 B2
(45) Date of Patent: Jul. 22, 2008

(54) ELEVATOR VIBRATION DAMPING APPARATUS AND METHOD

(75) Inventors: Josef Husmann, Luzern (CH); Elena Cortona, Thalwil (CH)

(73) Assignee: Inventio AG, Hergiswil (CH)

( * ) Notice: Subject to any disclaimer, the term of this patent is extended or adjusted under 35 U.S.C. 154(b) by 613 days.

(21) Appl. No.: 11/018,158

(22) Filed: Dec. 21, 2004

(65) Prior Publication Data

US 2005/0145439 A1 Jul. 7, 2005

(30) Foreign Application Priority Data

Dec. 22, 2003 (EP) ..... 03405919

(51) Int. Cl.
*B66B 1/34* (2006.01)

(52) U.S. Cl. ..... 187/292; 187/391

(58) Field of Classification Search ..... 187/277, 187/278, 292, 391–394, 409
See application file for complete search history.

(56) References Cited

U.S. PATENT DOCUMENTS 5,294,757 A 3/1994 Skalski et al.
5,304,751 A 4/1994 Skalski et al.
5,810,120 A * 9/1998 Jamieson et al. ..... 187/292
5,814,774 A * 9/1998 Remmers et al. ..... 187/292
5,824,976 A * 10/1998 Jamieson et al. ..... 187/393
5,864,102 A * 1/1999 Jamieson et al. ..... 187/292
5,896,949 A 4/1999 Hamdy et al.
5,929,399 A * 7/1999 Jamieson et al. ..... 187/391
6,089,355 A * 7/2000 Seki et al. ..... 187/292
7,164,251 B2 * 1/2007 Morishita ..... 318/727

* cited by examiner

*Primary Examiner*—Jonathan Salata
(74) *Attorney, Agent, or Firm*—Schweitzer Cornman Gross & Bondell LLP

(57) ABSTRACT

The present invention automatically detects the onset of instability of an elevator active ride control system and activates a system shutdown if it occurs. As an elevator car is guided along rails by guide elements, a plurality of sensors mounted on the car measure vibration transverse to a direction of travel. The signals from the sensors are input to a controller which in turn produces a controller output signal. This signal is used to energize an actuator positioned between the car and the guide elements and thereby dampen the vibrations acting on the car. As instability sets in, a controller signal increases. The controller signal is monitored by a comparator such that the actuator is deactivated if the controller signal becomes greater than a predetermined value.

6 Claims, 2 Drawing Sheets

ELEVATOR VIBRATION DAMPING APPARATUS AND METHOD

The present invention relates to a method and apparatus for detecting instability of a controller used to actively dampen vibrations on an elevator car in an elevator installation.

BACKGROUND OF THE INVENTION

U.S. Pat. No. 5,896,949 describes an elevator installation in which the ride quality is actively controlled using a plurality of electromagnetic linear actuators. Such a system is commonly referred to as an active ride control system. As an elevator car travels along guide rails provided in a hoistway, sensors mounted on the car measure the vibrations occurring transverse to the direction of travel. Signals from the sensors are input to a controller which computes the activation current required for each linear actuator to suppress the sensed vibrations. These activation currents are supplied to the linear actuators which actively dampen the vibrations and thereby the ride quality for passengers traveling within the car is enhanced.

The controller comprises a position controller with position feedback and an acceleration controller with acceleration feedback. The position controller is rather slow and its output is limited to a level so as not to cause overheating of the actuators. The output from the acceleration controller, however, is not restricted and can produce large amplitude resonance forces at the actuators.

All closed loop controllers can become unstable if feedback gain is too high. Indeed, the acceleration controller can become unstable very easily since the feedback gain margin that leads to stability can be as low as a factor of two. Hence, simple hardware failures or software errors can easily cause instability of the acceleration controller. An unstable situation would not necessarily harm the safety of any passengers traveling in the elevator car, but undoubtedly causes a considerable amount of discomfort for them. Since the active ride control system is solely designed to improve passenger comfort, an unstable and vibrating system would therefore defeat the purpose of, and completely undermine user confidence in, the active ride control system.

BRIEF DESCRIPTION OF THE INVENTION

Accordingly, the objective of the present invention is to detect instability of an active ride control system and to shut the system down if instability is detected. Although the vibration level will rise, it will not approach the level inherent in the unstable active ride control system.

In accordance with the invention, a plurality of sensors are mounted to the elevator car and provide outputs used for the control of at least one actuator of a vibration damping device, as known in the art. A controller is responsive to signals from the sensors and provides an output to energize the actuator. The controller includes a composition to temporarily deactivate the controller if a selected component of the controller output exceeds a predetermined value. Thus, an onset of instability resulting from actuator operation can be avoided.

The sensors employed may be position and acceleration sensors, the controller being responsive to outputs from both sensors. Because an acceleration controller often is prone to instability, the comparator may preferably compare the acceleration signal to a reference and deactivate the controller if the reference value is exceeded. A rms value of the acceleration controller's output may serve as the input to the comparator, and the maximum value to which the comparator input is compared may be temperature-dependent.

BRIEF DESCRIPTION OF THE DRAWINGS

By way of example only, a preferred embodiment of the present invention will be described in detail with reference to the accompanying drawings, in which.

DETAILED DESCRIPTION OF THE INVENTION

Figure 1:
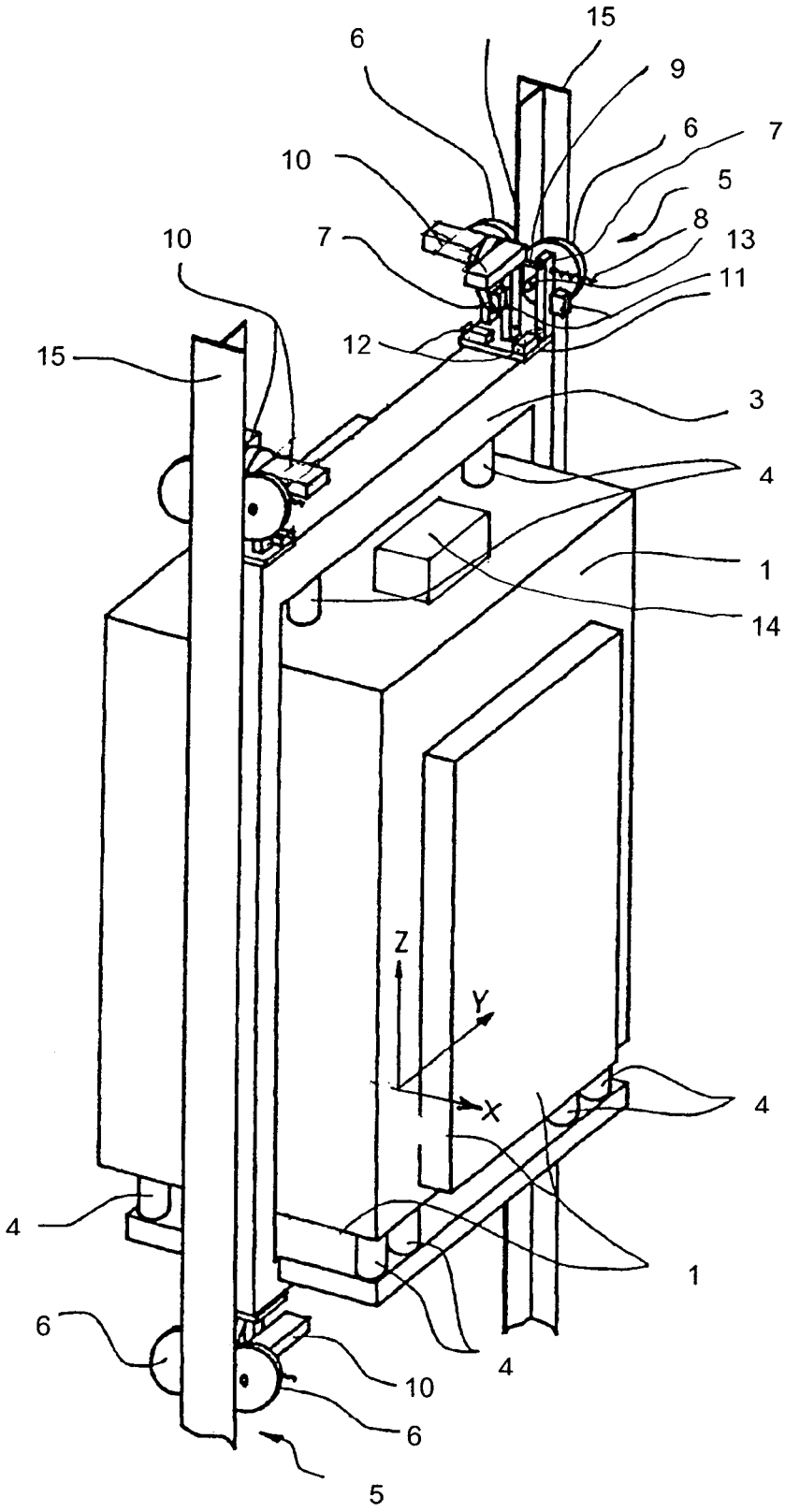
FIG. 1 is a schematic representation of an elevator car traveling along guide rails, the car incorporating linear actuators to suppress vibration of the car.

FIG. 1 is a schematic illustration of an elevator installation incorporating an active ride control system according to U.S. Pat. No. 5,896,949. An elevator car 1 is guided by roller guide assemblies 5 along rails 15 mounted in a shaft (not shown). Car 1 is suspended elastically in a car frame 3 for passive oscillation damping. The passive oscillation damping is performed by several rubber springs 4, which are designed to be relatively stiff in order to isolate sound or vibrations having a frequency higher than 50 Hz.

The roller guide assemblies 5 are laterally mounted above and below car frame 3. Each assembly 5 includes a mounting bracket and three rollers 6 carried on levers 7 which are pivotally connected to the bracket. Two of the rollers 6 are arranged laterally to engage opposing sides of the guide rail 15. The levers 7 carrying these two lateral rollers 6 are interconnected by a linkage 9 to ensure synchronous movement. The remaining, middle roller 6 is arranged to engage with a distal end of the guide rail 15. Each of the levers 7 is biased by a contact pressure spring 8 towards the guide rail 15. This spring biasing of the levers 7, and thereby the respective rollers 6, is a conventional method of passively dampening vibrations.

Each roller guide assembly 5 further includes two electrical actuators 10 disposed to actively move the middle lever 7 in the y direction and the two interconnected, lateral levers 7 in the x direction, respectively.

Unevenness in rails 15, lateral components of traction forces originated from the traction cables, positional changes of the load during travel and aerodynamic forces cause oscillations of car frame 3 and car 1, and thus impair travel comfort. Such oscillations of the car 1 are to be reduced. Two position sensors 11 per roller guide assembly 5 continually monitor the position of the middle lever 7 and the position of the interconnected lateral levers 7, respectively. Furthermore, accelerometers 12 measure transverse oscillations or accelerations acting on car frame 3.

The signals derived from the positions sensors 11 and accelerometers 12 are fed into a controller box 14 mounted on top of the car 1. The controller box 14 contains the power electronics necessary to drive the actuators 10 and a closed loop feedback controller 19 processing the signals from the sensors 11 and 12 to operate the actuators 10 in directions such to oppose the sensed oscillations. Thereby, damping of the oscillations acting on frame 3 and car 1 is achieved. Oscillations are reduced to the extent that they are imperceptible to the elevator passenger.

Figure 2:
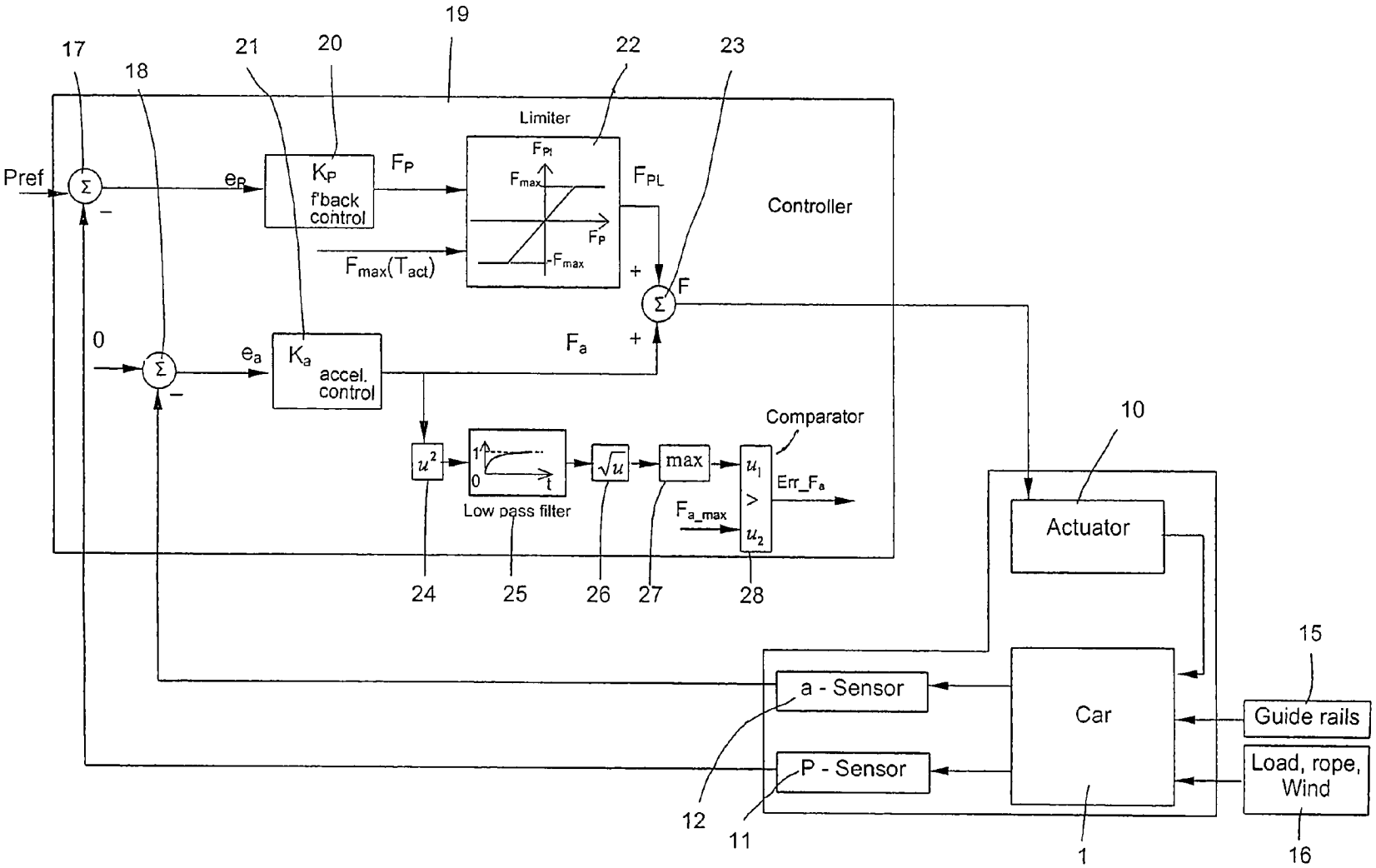
FIG. 2 shows a signal flow scheme of the active ride control system for the elevator installation of FIG. 1 incorporating instability detection according to the present invention.

FIG. 2 shows a signal flow diagram of the active ride control system for the elevator installation of FIG. 1 incorporating instability detection according to the present invention. External disturbances act on the car 1 and frame 3 as they travel along the guide rails 15. These external disturbances generally comprise high frequency vibrations due mainly to the unevenness of the guide rails 15 and relatively low frequency forces 16 produced by asymmetrical loading of the car 1, lateral forces from the traction cable and air disturbance or wind forces. The disturbances are sensed by the positions sensors 11 and accelerometers 12 which produce signals that are fed into the controller 19.

In the controller 19, the sensed position signals are compared to reference value $P_{ref}$ at summation point 17 to produce position error signal $e_p$. The position error signal $e_p$ are then fed into a position feedback controller 20 which produces an output signal $F_p$ which is restricted to a maximum absolute value $F_{max}$ by a limiter 22. The value of $F_{max}$ depends on the temperature $T_{act}$ of the electrical actuators 10 and on their ability to endure thermal stress. This temperature limitation is fully described at pages 5-6 in our concurrently-filed, co-pending U.S. Application "Thermal Protection of Electromagnetic Actuators". The output $F_{pL}$ from the limiter 22 is fed into summation point 23.

The signals from the accelerometers 12 are inverted at a summation point 18 and fed into an acceleration feedback controller 21 as acceleration error signal $e_a$. The output $F_a$ from the acceleration controller 21 is combined with the output $F_{PL}$ from the limiter 22 at summation point 23. The resulting output control signal F is used as the input for a power amplifier (not shown) to produce current for the actuators 10 to counteract the disturbance forces and thus reduce vibrations on the car 1.

The output $F_a$ of the acceleration controller 21 contains a broad band of frequencies and the amplitude of the higher frequency signals can be relative large. To detect instability it is not sufficient to look at the amplitude of the signal; time duration has also to be weighed. A good measurement of stability is the moving root mean square or RMS value. It is a measure for the energy or power that is contained in a signal and time duration weighting can be chosen freely. The moving RMS value can be compared with a maximum admissible value and if it exceeds the admissible value an error flag is set true. The error signal will then deactivate the active ride control system and the elevator car will continue its operation with passive vibration damping. Deactivation can mean either the switch off or the gradual reduction of the current supplied to the actuator 10. In the present embodiment the output signal $F_a$ of the acceleration controller is squared in block 24. The squared signal has always a positive sign. In block 25 the squared signal is filtered through a first order low pass filter. The time constant of the low pass filter has to be defined by knowledge of the system and based on experience. In block 26 the square root of the filtered signal is calculated. Since the signal is a vector signal, which contains several values, the maximum value is chosen in block 27 and therefore the output from block 27 represents the signal with the largest RMS amplitude. It is compared against a maximum admissible value $F_{a_max}$ in block 28. If the largest RMS signal is greater than the admissible value, an error flag Err_Fa is set true and the active ride control system is switched off. The admissible value again is derived by knowledge of the system and based on experience. The active ride control system is reactivated after a predetermined time period.

It will be appreciated that the guide assemblies 5 may incorporate guide shoes rather then rollers 6 to guide the car 1 along the guide rails 15.

We claim:

1. An apparatus for damping vibrations of an elevator car, the elevator car guided along rails by guide elements, comprising:

a plurality of sensors mounted on the car for measuring vibrations transverse to a direction of travel, the sensors including a position sensor and an accelerometer;

at least one actuator positioned between the car and the guide elements; and a closed-loop feedback controller responsive to signals from the sensors for producing a controller output signal to energize the actuator, the controller comprising a position controller and an acceleration controller responsive to signals from the position sensor and accelerometer, respectively, and means for combining outputs from the position controller and accelerometer to provide the controller output signal;

the controller further including a comparator to temporarily deactivate the actuator if a selected component of the controller output signal is greater than a predetermined value, thereby preventing an onset of instability.

2. The apparatus according to claim 1, wherein the selected component of the controller signal is an output from the acceleration controller.

3. The apparatus according to claim 2, wherein the output from the acceleration controller is passed through a root-mean-square determining unit and a maximum value determined is input to the comparator.

4. The apparatus according to claim 1, 2 or 3 wherein the controller further comprises a limiter to restrict the output from the position controller to a maximal value dependent on a temperature of the actuator.

5. A method for reducing oscillations of an elevator car, the elevator car guided along rails by guide elements, comprising the steps of:

measuring oscillations of the car transverse to a direction of travel, including measuring a position and an acceleration of the car;

providing a control signal for energizing at least one actuator positioned between the car and the guide elements in response to the measured oscillations; and deactivating the actuator if an acceleration component of the control signal is greater than a predetermined value and thereby preventing an onset of instability.

6. The method according to claim 5 further comprising the step of restricting a position component of the control signal to a maximal value dependent on a temperature of the actuator.

* * * * *